US009202372B2

(12) United States Patent
Reams et al.

(10) Patent No.: US 9,202,372 B2
(45) Date of Patent: Dec. 1, 2015

(54) SYSTEMS AND METHODS FOR REMOTE CONTROL SETUP

(75) Inventors: William R. Reams, Englewood, CO (US); Matthew P. Zenthoefer, Centennial, CO (US)

(73) Assignee: EchoStar Technologies L.L.C., Englewood, CO (US)

( * ) Notice: Subject to any disclaimer, the term of this patent is extended or adjusted under 35 U.S.C. 154(b) by 1032 days.

(21) Appl. No.: 12/492,955

(22) Filed: Jun. 26, 2009

(65) Prior Publication Data

US 2009/0322583 A1 Dec. 31, 2009

Related U.S. Application Data

(60) Provisional application No. 61/076,518, filed on Jun. 27, 2008.

(51) Int. Cl.
*G08C 19/16* (2006.01)
*G08C 19/28* (2006.01)

(52) U.S. Cl.
CPC ..... *G08C 19/28* (2013.01); *G08C 2201/21* (2013.01); *G08C 2201/92* (2013.01)

(58) Field of Classification Search
None
See application file for complete search history.

(56) References Cited

U.S. PATENT DOCUMENTS 4,706,121 A * 11/1987 Young ..... 348/27
4,841,368 A 6/1989 Rumbolt et al.
5,671,267 A * 9/1997 August et al. ..... 455/420
5,963,624 A * 10/1999 Pope ..... 379/110.01
6,747,568 B1 * 6/2004 Teskey ..... 340/12.28
7,538,686 B2 * 5/2009 Yeh et al. ..... 340/12.54
7,589,642 B1 * 9/2009 Mui ..... 340/12.3
7,853,773 B1 * 12/2010 Chan ..... 711/219
7,916,040 B2 3/2011 Andersen et al.
7,956,792 B2 * 6/2011 Chen et al. ..... 341/176
7,973,648 B2 7/2011 Kawakita
8,116,889 B2 2/2012 Krzyanowski et al.
8,233,803 B2 * 7/2012 Meyer et al. ..... 398/106

(Continued)

FOREIGN PATENT DOCUMENTS

WO 03083588 A2 10/2003

OTHER PUBLICATIONS

USPTO "Notice of Allowance" dated Jul. 17, 2012 for U.S. Appl. No. 12/390,268, filed Feb. 20, 2009.

(Continued)

*Primary Examiner* — Kerri McNally
*Assistant Examiner* — Renee Dorsey
(74) *Attorney, Agent, or Firm* — Ingrassia Fisher & Lorenz, P.C.

(57) ABSTRACT

A remote control device may include: first circuitry to control a function of a first electronic device; second circuitry to be set to control a function of a second electronic device; and a setup controller to set the second circuitry to control a function of a target electronic device based on a code received from a separate device. An electronic device to be controlled by a remote control device may include: an input device to receive a signal from the remote control device; an output device to send a signal to the remote control device; and a processor coupled to the input and output devices, and configured to access a database of codes and to selectively provide codes from the database to the remote control device, the codes configured to set circuitry of the remote control device to control a function of the electronic device and/or an auxiliary electronic device.

18 Claims, 7 Drawing Sheets

(56) References Cited

U.S. PATENT DOCUMENTS

| | | | | |
|---|---|---|---|---|
| 2002/0130803 | A1* | 9/2002 | Conway et al. | 341/176 |
| 2004/0070491 | A1* | 4/2004 | Huang et al. | 340/10.5 |
| 2005/0110651 | A1 | 5/2005 | Martis et al. | |
| 2005/0151726 | A1* | 7/2005 | Wouters | 345/172 |
| 2006/0232377 | A1 | 10/2006 | Witkowski | |
| 2007/0273655 | A1* | 11/2007 | Yeh et al. | 345/169 |

OTHER PUBLICATIONS

USPTO "Notice of Allowance" dated Nov. 16, 2012 for U.S. Appl. No. 12/390,268, filed Feb. 20, 2009.

European Patent Office, Extended Search Report, dated Oct. 23, 2014 for European Patent Application No. 10154143.1.

* cited by examiner

SYSTEMS AND METHODS FOR REMOTE CONTROL SETUP

RELATED APPLICATION

This application is related to and claims priority to U.S. Provisional Patent Application Ser. No. 61/076,518, filed Jun. 27, 2008, and entitled "Systems and Methods for Remote Control Setup." The entire disclosure of this provisional patent application is incorporated herein by reference.

FIELD OF THE INVENTION

The present invention relates generally to remote control electronics, and more particularly to systems and methods for setting up circuitry of a remote control to control one or more controllable electronic devices.

BACKGROUND ART

Advancements in consumer electronic devices have led to a wide variety of such devices that may be operated remotely, i.e., at a distance from the device, using an associated remote control. Moreover, universal, learning, programmable or "smart" remote controls have been developed to allow a user to operate one or more devices remotely using a single remote control and/or to replace one or more remote controls.

Most remote controls are hand-held devices that provide a user interface, such as a keypad, touchpad, slider switch, or the like, for a user to select various functions of the corresponding device or devices to be controlled. Also, most remote controls are wireless, battery-powered devices to facilitate their portability to locations from which the user may wish to control the corresponding device(s), although some wired remote controls exist. Common wireless remote controls are configured to communicate with the device(s) to be controlled via various known wireless modes, such as infrared, radiowave, and the like.

The complexity of remote controls has increased along with the increased complexity of the devices that are controlled. Consumer demand has driven such complexity, at least in part, as users expect substantial or complete functionality of controlled devices via the associated remote control.

BRIEF SUMMARY

Both the increased number of controllable electronic devices and the increased complexity and functionality in remote controls bring an associated increase in the cost of remote controls. In particular, greater storage or memory capacity is required in remote controls to accomplish the increased functionality. Further, "smart" remote controls may include a database of codes that allow the circuitry of the remote controls to be set to control corresponding controllable electronic devices. In such remote controls, greater storage or memory capacity is required due to the increased size of the database corresponding to the increased number of controllable devices and associated codes.

As such, it may be desirable to provide some functionality that has typically been provided by the remote control in some fashion via a device other than the remote control. Locating some functionality in the other device, including some of the associated electronics for performing such functions, rather than in the remote control may reduce the cost of the remote control. In particular, some of the functionality of remote control setup and the associated electronics may be provided in a device other than the remote control. However, it may be desirable to provide a similar setup experience to a user who may be familiar with setup of a remote control device that includes all such functionality and associated electronics.

Thus, various systems and methods disclosed herein may involve setting up circuitry of a remote control device to control an auxiliary controllable electronic device via two-way communication with a main controllable device. For example, various systems and methods described herein may provide the main controllable electronic device with access to a database of codes that are configured to set circuitry of remote control devices to control one or more functions of controllable electronic devices. For example infrared (IR) transmit circuitry may be configured for appropriate modulation rates, bit rates, data patterns, etc. In various embodiments, the database may be stored in a storage device of the main controllable electronic device.

In such embodiments, because the database of codes is not stored in the remote control device, storage or memory requirements for the remote control device may be reduced. Also, storing the database in a device separate from the remote control device may facilitate management of the database, such as updating to add new codes, to replace codes, to remove obsolete or unused codes, and the like.

One embodiment may take the form of a remote control device. The remote control device may include: first circuitry configured to wirelessly control at least one function of a main controllable electronic device upon receipt of user input; second circuitry configured to be set to wirelessly control at least one function of an auxiliary controllable electronic device upon receipt of receive user input; a setup controller configured to set the second circuitry to wirelessly control at least one function of a target auxiliary controllable electronic device based on a code received from a separate device. In such an embodiment, the setup controller may be configured to set the second circuitry based on a code received from the main controllable device.

Another embodiment may take the form of a controllable electronic device configured to be controlled by a remote control device. The controllable electronic device may include: an input device configured to receive at least one wireless signal from the remote control device; an output device configured to send at least one wireless signal to the remote control device; and a processor coupled to the input device and to the output device, configured to access a database of codes and to selectively provide codes from the database to the remote control device via the output device, the codes being configured to set circuitry of the remote control device to wirelessly control at least one function of at least one of the controllable electronic device and an auxiliary controllable electronic device. In such an embodiment, the controllable electronic device may further include a storage device, wherein the storage device stores the database of codes to be accessed by the processor.

Another embodiment may take the form of a controllable electronic device configured to be controlled by a remote control device. The controllable electronic device may include: circuitry configured to perform a plurality of operations in response to signals from a remote control device. At least one of the plurality of functions may be to provide at least one signal to the remote control device. The at least one signal may be adapted to enable the remote control device to control another controllable electronic device.

Another embodiment may take the form of a method for setup of a remote control device. The method may include: providing a remote control device including a plurality of circuitry for wirelessly controlling electronic devices; and communicating a code to the remote control device from a separate device, the code being configured to set at least one of the plurality of circuitry of the remote control device to wirelessly control at least one function of a controllable electronic device. In such an embodiment, the controllable electronic device may be the separate device.

The method may further include: determining whether the code communicated to the remote control device is configured to set at least one of the plurality of circuitry of the remote control device to wirelessly control at least one function of a target controllable electronic device; and, when it is determined that the code communicated to the remote control device is configured to set at least one of the plurality of circuitry of the remote control device to wirelessly control at least one function of a target controllable electronic device, communicating a codeset to the remote control device from the separate device, the code set being configured to set at least some of the plurality of circuitry of the remote control device to control a plurality of functions of the target controllable electronic device. In such an embodiment, determining whether the code communicated to the remote control device is configured to set at least one of the plurality of circuitry of the remote control device to wirelessly control at least one function of the target controllable electronic device may include: causing at least one of the plurality of circuitry of the remote control device to send a first signal to the target controllable electronic device; and, when the target controllable electronic device performs the function(s) in response to the first signal, sending a second signal to the separate device that indicates that the code communicated to the remote control device successfully set the circuitry of the remote control device to wirelessly control at least one function of the target controllable electronic device.

Another embodiment may take the form of a method of setting up a remote control device to control a controllable electronic device. The method may include: receiving a signal from the remote control device at a first controllable electronic device; and sending a setup signal from the first controllable electronic device to the remote control device to control a controllable electronic device other than the first controllable electronic device.

Another embodiment may take the form of a system for setup of a remote control device. The system may include: a remote control device including a plurality of circuitry for wirelessly controlling electronic devices; a main controllable electronic device associated with the remote control device such that some of the plurality of circuitry of the remote control device are configured to wirelessly control the main controllable electronic device; and a database of codes separate from the remote control device, the codes of the database being configured to set circuitry of the remote control device to wirelessly control at least one function of an auxiliary controllable electronic device. In such an embodiment, the main controllable electronic device may be configured to communicate a code from the database to the remote control device. Further, the main controllable electronic device may include a storage device that stores the database.

Another embodiment may take the form of a system for setup of a remote control device. The system may include: a remote control device including circuitry capable of being set up to wirelessly control an auxiliary controllable electronic device; and a main controllable electronic device associated with the remote control device such that some of the plurality of circuitry of the remote control device are configured to wirelessly control the main controllable electronic device. The remote control device and the main controllable electronic device may be configured to set up the circuitry capable of being set up, via two-way communication between the remote control device and the main controllable electronic device, to control an auxiliary controllable electronic device.

Another embodiment may take the form of a method for managing a database of codes for setup of a remote control device. The method may include: providing a database including a plurality of codes, each of the codes being configured to set circuitry of a remote control device to wirelessly control at least one function of a controllable electronic device; and updating the database by at least one of adding a code to the database, deleting one of the plurality of codes from the database; and modifying a code in the database. In such an embodiment, providing the database may include storing the database in a storage device of a controllable electronic device. The method may further include: tracking usage of the plurality of codes of the database to set circuitry of remote control devices; and deleting a code from the database based on a lack of usage of the code set circuitry of remote control devices for a period of time.

DETAILED DESCRIPTION

Figure 1:
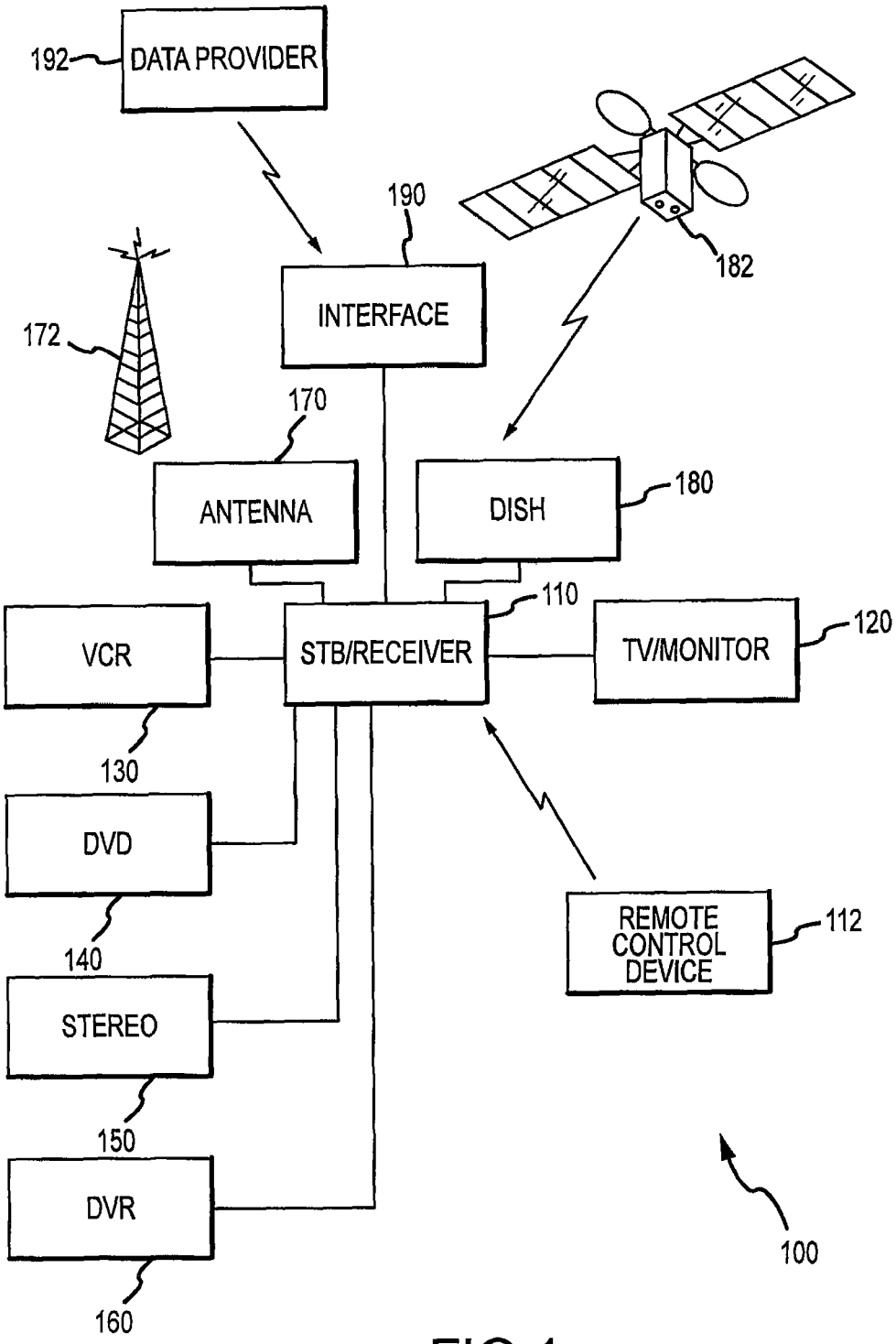
FIG. 1 is a schematic representation of a home entertainment system in which embodiments described herein may be employed.

The following describes various embodiments of systems and methods that may be used to setup a remote control device, particularly a wireless remote control device. Although specific embodiments may be described in detail, the embodiments disclosed should not be interpreted or otherwise used to restrict the scope of the disclosure provided herein. It should be understood that the following description has broad application, and the discussion of specific embodiments is meant only to be exemplary, and is not intended to represent the only embodiments contemplated and encompassed by this disclosure. References to various "circuitry" herein should be understood to include, but not be limited to, wired circuits, traces, integrated circuits, processors, memories, displays, interfaces, and the like that may be employed to receive user input and generate output for controlling an electronic device according to such input, as is well known in the remote control electronics arts.

As discussed above, various systems and methods disclosed herein may allow for setup of a remote control device to have circuitry thereof set to control one or more functions of a controllable electronic device. The disclosure provided herein is provided in terms of setup of a remote control device to have circuitry thereof set to control one or more functions an auxiliary controllable electronic device. However, it should be understood that the systems and methods described may also be used, with or without modification as appropriate or desired, to setup a remote control device to have circuitry thereof set to control one or more functions of a main controllable electronic device. The terms "auxiliary controllable electronic device" and "main controllable electronic device" are further explained herein.

Various systems and methods described herein employ a database of codes that are stored in a device separate from the remote control device. As such, storage or memory capabilities of the remote control device need not be increased to accommodate the database of codes. Further, storage of the database in the separate device may facilitate management of the database. These and other advantages of the various systems and methods described herein will become apparent from this disclosure.

In general, it may be desirable to setup a remote control device to control various controllable electronic devices. As noted above, universal, learning, programmable or other "smart" remote control devices are known for accomplishing such setup. A particular technique that is desirable involves a database of codes stored in the remote control device. However, as discussed above, this may not be such a desirable technique given the increases in the complexity and the functionality of remote controls and in the number of controllable electronic devices potentially to be controlled. Approaches for setup of a remote control device described herein may involve novel remote control devices, novel controllable electronic devices, as well as novel systems and novel methods that allow a database of codes to be used in n efficient manner.

The systems and methods described herein may be employed, for example, in a home entertainment system 100, as illustrated in FIG. 1. Of course, it should be understood that a home entertainment system and the components thereof are merely examples of electronic devices to which the systems and method described herein may be applied. As such, it should be understood that any electronic device that is controlled wirelessly via a remote control device may benefit from or otherwise be employed with such systems and methods.

As illustrated, the home entertainment system 100 may include a set top box (STB) or receiver 110 as a main controllable electronic device. A remote control device 112 may be configured to wirelessly control the STB/receiver 110, as well as the other components of the home entertainment system 100, as discussed below. The STB/receiver 110 may be configured to operate as a "hub" or central device for interconnecting various other components of the home entertainment system 100. Alternatively, the STB/receiver 110 may be configured to operate independently, with only data being communicated therebetween, for example, for display or recording.

The STB/receiver 110 may be configured to receive inputs from an antenna 170, a satellite dish 180, and/or any other suitable interface 190 (such as a telephone line, coaxial cable, fiber optics, Ethernet, or the like), which are respectively configured to receive over-air signals from a broadcast source 172, satellite signals from a satellite source 182, and appropriate signals from any suitable data provider 192. A basic arrangement of the home entertainment system 100 may include the STB/receiver 110, one of the antenna 170, the satellite dish 180 or the interface 190, and a television (TV)/monitor 120. Typically, the antenna 170, the satellite dish 180 and/or the interface 190, and the TV/monitor 120 are coupled to the STB/receiver 110 so that television programs or other content from the broadcast source 172, the satellite source 182 and/or the data provider 192 may be communicated to the STB/receiver 110 and, for example, displayed on the television monitor 120, as appropriate or desired.

In such an arrangement, the remote control device 112 may be configured to control the STB/receiver 110 as well as the TV/monitor 120. Although not illustrated, it may be envisioned that the STB/receiver 110 is coupled to a plurality of TV/monitors 120, for example, for multiple room arrangements. In such case, a plurality of remote control devices 112 may be employed, each associated with one of the TV/monitors 120. In either case, the STB/receiver 110 or the TV/monitor(s) 120 may be considered to be a main controllable electronic device for a respective remote control device 112. In other words, the remote control device(s) 112 may include circuitry that is preset to control the STB/receiver 110 or the TV/monitor(s) 120 as a main controllable electronic device. For the sake of the description provided herein, the STB/receiver 110 is assumed to be the main controllable electronic device. It should be understood, however, that any controllable electronic device may serve as a main controllable electronic device as described herein.

As illustrated in FIG. 1, additional components of the home entertainment system 100 may include a videocassette recorder (VCR) 130, a digital video disc (DVD) player/recorder 140, a stereo 150, and a digital video recorder (DVR) 160. It should be understood that such controllable electronic devices are only examples, and thus not limiting or exhaustive. Further, although each of these components are illustrated as being coupled to the STB/receiver 110, it should be understood that a different electronic device, such as a home theater audio/visual receiver, a processor of the stereo 150, a personal computer, or the like, may serve as central electronic device coupled to the other electronic devices. As described further below, the remote control device 112 may include circuitry configured to control the STB/receiver 110 as a main controllable electronic device and circuitry configured to control each of the components 120, 130, 140, 150, 160 as auxiliary controllable electronic devices.

Figure 2:
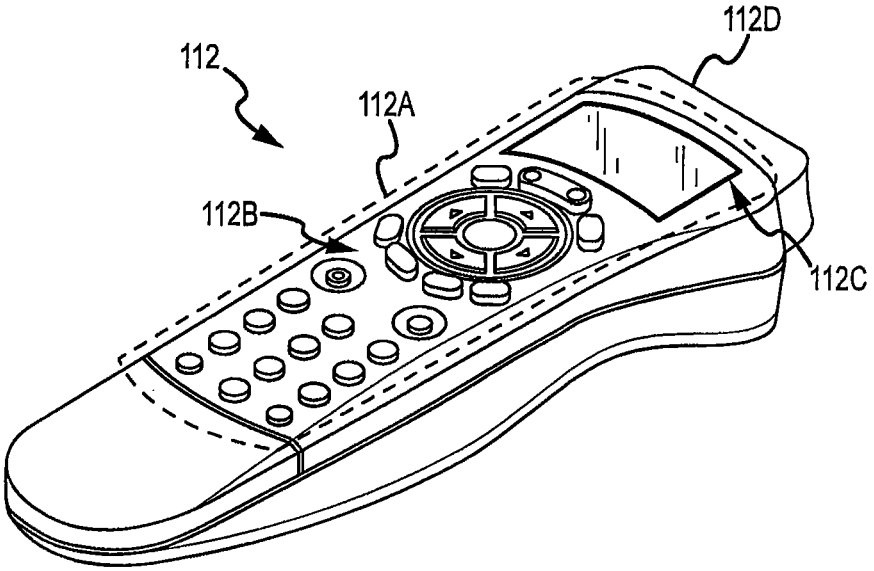
FIG. 2 is a perspective view of a remote control device that may be employed in the systems and methods described herein.

The remote control device 112 may be of any suitable design capable of performing the functions and operations described herein in relation thereto. Thus, it should be understood that the particular implementation illustrated in FIG. 2 is only an example, and that the disclosure provided herein is not limited to such an implementation of a remote control device.

As illustrated, the remote control device 112 may include a user interface portion 112A that is configured to receive user input via a keypad 112B, as illustrated, or any other suitable mechanism, either known or hereafter developed. The remote control device 112 may also include a display 112C configured to provide information to the user, such as a mode of the remote control device 112, a current operation of the remote control device 112, remote setup status, battery status, and the like. Also, though not exhaustive of the features that the remote control device 112 may include, the remote control device 112 may include an input/output interface or transceiver 112D, such as an infrared (IR) and/or radio frequency (RF) transceiver, configured to send and receive signals to and from controllable electronic devices, to wirelessly communicate therewith.

Figure 3:
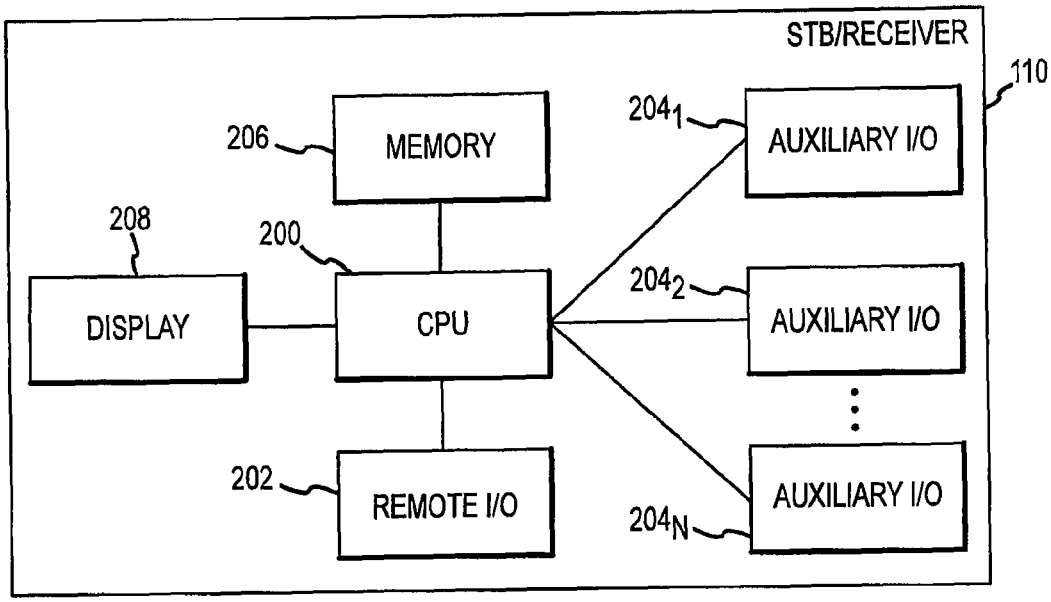
FIG. 3 is a block diagram of a set top box/receiver that may be employed in systems and methods described herein.

In the case of the STB/receiver 110 configured to operate as a central electronic device for interconnecting various other components, one embodiment of the STB/receiver 110 may include features as illustrated in FIG. 3. The STB/receiver 110 may include a processor or central processing unit (CPU) 200 that is coupled to a remote input/output (I/O) device 202 configured to wirelessly communicate with the remote control device 112. It should be understood that the remote I/O device 202 may be one or more devices capable of receiving information from and sending information to the remote control device 112 in any known or hereafter developed manner, such as infrared, radio frequency (RF), or the like. Further, it should be understood that the CPU 200 may be the main processor of the STB/receiver 110 that is configured to perform and/or control various operations and functions of the STB/receiver 110 in addition to those discussed herein, or may be a separate processor, for example, dedicated to the operations and functions associated with controlling the power state(s) of the circuitry of the remote control device 112 as described herein.

The CPU 200 may be coupled to one or more auxiliary input/output (I/O) devices $\mathbf{204}_1$, $\mathbf{204}_2$ through $\mathbf{204}_N$ that are configured to provide communications with the various components 120, 130, 140, 150, 160, as appropriate or desired. Further, the CPU 200 may be coupled to a memory 206 that may be configured to store information regarding the STB/receiver 110 as well as a database of codes as discussed herein. It should be understood that any suitable memory device or other storage device may be employed. The STB/receiver 110 may include a display 208 that is configured to provide information to the user, such as a mode or a current operation of the STB/receiver 110 and/or the remote control device 112, remote setup status, battery status, and the like. Thus, the display 208 of the STB/receiver 110 may be in addition to or an alternative to the TV/monitor 120 and/or the display 112C of the remote control device 112, and the display of information may be apportioned to the remote control device 112 and/or to the STB/receiver 110, as appropriate or desired.

Figure 4:
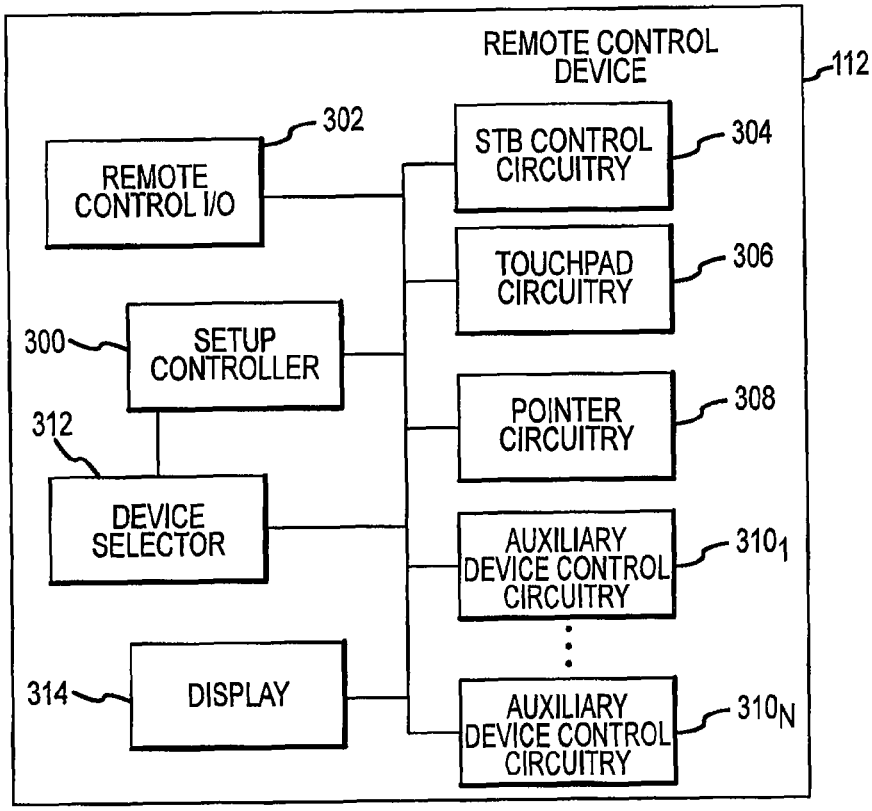
FIG. 4 is a block diagram of a remote control device that may be employed in systems and methods described herein.

In the case of a single remote control device 112, which may be extended as appropriate or desired to arrangements involving multiple remote control devices, one embodiment of the remote control device 112 is illustrated in FIG. 4. The remote control device 112 may include setup controller 300 coupled to a remote control input/output (I/O) device 302 that is configured to wirelessly communicate with the STB/receiver 110. It should be understood that the setup controller 300 may be any suitable controller, processor, circuitry, or the like, that is capable of performing the operations and functions described herein. Further, it should be understood that the remote control I/O device 302 may be one or more devices capable of receiving information from and sending information to the STB/receiver 110 in any known or hereafter developed manner, such as infrared, radio frequency (RF), or the like.

The remote control device 112 may further include various circuitry configured to receive user input for controlling various electronic devices and functions thereof. As discussed above, the term circuitry is intended to include features such as touchpads and displays, in addition to wired circuits, integrated circuits, or the like. The remote control device 112 may include, for example, STB control circuitry 304, touchpad circuitry 306, and pointer circuitry 308. The STB control circuitry 304 may be configured to receive user input for controlling various functions of the STB/receiver 110. The touchpad circuitry 306 may be an area configured to receive user input via a finger, a stylus, or the like, and may be configured to control one or more electronic devices, as appropriate or desired, for example, based on setup of the remote control device 112. The pointer circuitry 308 may be configured to interact with an on-screen menu displayed on the TV/monitor 120, for example, by moving and pointing the remote control device 112 at items of the on-screen menu and/or controlling a cursor thereof.

The remote control device 112 may also include auxiliary device control circuitry $\mathbf{310}_1$ through $\mathbf{310}_N$ for each of a plurality of auxiliary electronic devices that the remote control device 112 may be configured to control, such as the components 120, 130, 140, 150 and/or 160. Each of the auxiliary device control circuitry $\mathbf{310}_1$ through $\mathbf{310}_N$, STB control circuitry 304, touchpad circuitry 306, and pointer circuitry 308 may be coupled to the setup controller 300. The setup controller 300, as well as the circuitry $\mathbf{304}$-$\mathbf{310}_{1\text{-}N}$ of the remote control device 112, may be coupled to a device selector 312, which may be any suitable device or circuitry configured to allow selection between the various circuitry $\mathbf{304}$-$\mathbf{310}_{1\text{-}N}$ for setup and/or control operations, as appropriate or desired. Although not illustrated for purposes of this disclosure, it should be understood that the remote control device 112 may include other features, such as a memory or other storage device, for example, for storing control functions set for the various circuitry $\mathbf{304}$-$\mathbf{310}_{1\text{-}N}$ Additionally, the remote control device 112 may be operable in multiple control modes, allowing the remote control device 112 to control various functions of several different controllable electronic devices depending on the control mode selected or active. For example, a touchpad slider may be used to control a channel of the TV/monitor 120 in one mode, while the touchpad slider may be used to scroll through a menu when a menu is displayed on the screen of the TV/monitor 120.

In the remote control device 112 illustrated in FIG. 4, the STB control circuitry 304 may be considered first circuitry configured to wirelessly control at least one function of a main controllable electronic device, e.g., the STB/receiver 110 (FIGS. 1 and 3). Similarly, the circuitry 306, 308 and/or $\mathbf{310}_{1\text{-}N}$ may be considered to be second circuitry configured to be set to wirelessly control at least one function of a respective auxiliary controllable electronic device, e.g., components 120, 130, 140, 150, 160 (FIG. 1). The setup controller 300 may be configured to set the second circuitry to wirelessly control at least one function of a target auxiliary controllable electronic device, for example, one of the components 120, 130, 140, 150 or 160, based on a code received from a separate device. In particular, the separate device may be a controllable electronic device, such as any one of 120, 130, 140, 150 or 160 shown in FIG. 1. For example, the setup controller 300 may be configured to set the second circuitry based on a code received from the main controllable electronic device, e.g., the STB/receiver 110.

Figure 5:
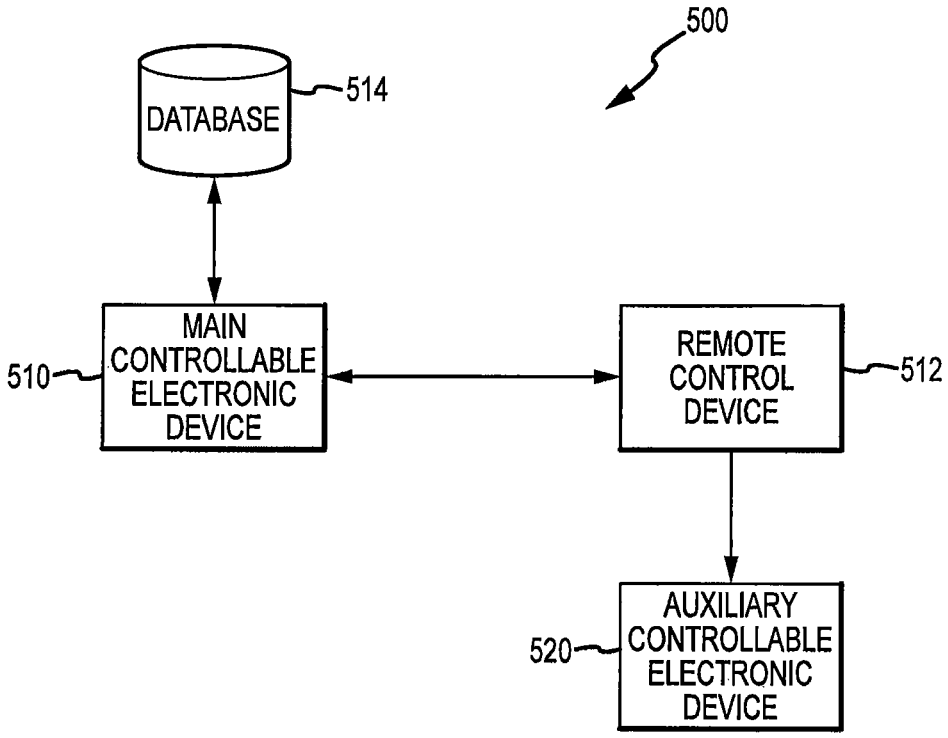
FIG. 5 is a schematic block diagram of an example of a system for setup of a remote control device.

A general example of a system 500 for setup of a remote control device is illustrated in FIG. 5. The system 500 may include a main controllable electronic device 510 and a remote control device 512. The main controllable electronic device 510 may include or may otherwise have access to a database 514, which contains codes configured to set circuitry of an auxiliary controllable electronic device 520. When the remote control device 512 is to be setup to control the auxiliary controllable electronic device 520, the auxiliary controllable electronic device 520 may be considered to be a target auxiliary controllable electronic device.

To set circuitry of the remote control device 512 to control the auxiliary controllable electronic device 520, communication between the main controllable electronic device 510 and the remote control device 512 may be established. Such communication may communicate a code, accessed from the database 514 by the main controllable electronic device 510, from the main controllable electronic device 510 to the remote control device 512. If the communicated code is successful in setting circuitry to control a function of the auxiliary controllable electronic device 520, then, based on the communicated code, appropriate circuitry of the remote control device 512 may be set to control one or more functions of the auxiliary controllable electronic device 520. It should be understood that the communications represented by lines between the components illustrated in FIG. 5 may be performed wirelessly or via wired connections, as appropriate or desired.

Figure 6:
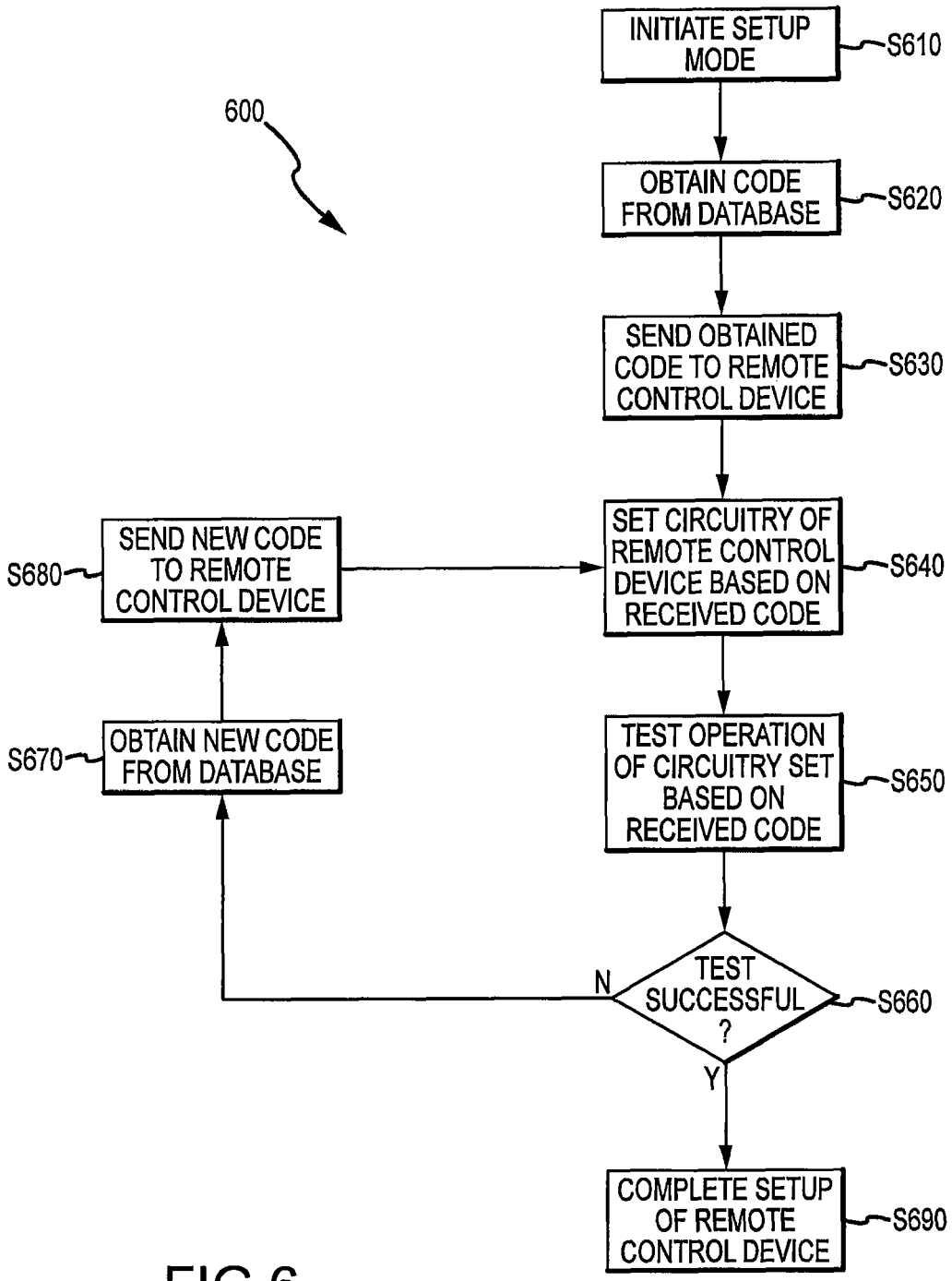
FIG. 6 is a flowchart illustrating an example of a method for setup of a remote control device.

For example, embodiments of the system 500 may be configured to perform a method 600 as illustrated in FIG. 6. The process may begin at S610, where a setup mode may be initiated. The setup mode may be initiated by the remote control device and/or by the main controllable electronic device, such as the STB/receiver. The setup mode may establish a two-way communication between the remote control device and the main controllable electronic device to carry out setup of the remote control device.

Once in the setup mode, a code may be obtained from the database of codes by the main controllable electronic device at S620. As discussed above, this may involve the main controllable electronic device accessing the database stored therein, or may involve the main controllable electronic device obtaining the code from another device separate from the remote control device.

Next, at S630, the main controllable electronic device may send the obtained code to the remote control device, and circuitry of the remote control device may be set based on the received code, at S640. The code may be designed, for example, to set circuitry of the remote control device to control a particular function of the target auxiliary controllable electronic device, such as powering on/off or muting as discussed below.

Once the circuitry is set based on the received code, operation of the set circuitry may be tested at S650. The testing may involve a user actuating the set circuitry to cause a signal to be sent from the remote control device to the target auxiliary controllable electronic device to see if the corresponding function is performed by the target auxiliary controllable electronic device in response. Alternatively, the signal of the set circuitry may be automatically sent from the remote control device to the target auxiliary controllable electronic device, either after the circuitry is set or simultaneously with the setting of the circuitry.

Next, at S660, a determination is made whether the test is successful, i.e., that the target auxiliary controllable electronic device performed the corresponding function in response to the signal. This determination may involve the user observing the target auxiliary controllable electronic device performed the corresponding function in response to the signal and providing an input to the remote control device to indicate success. Alternatively, this determination may be automated in any suitable manner. For example, performance of the corresponding function by the target auxiliary controllable electronic device may be accompanied by the target auxiliary controllable electronic device sending a signal to the remote control device to indicate success.

If no user input or signal occurs, for example, within a predetermined time, the test may be determined to be unsuccessful at S660. In the event that the test is determined to be unsuccessful at S660, a new code may be obtained from the database at S670. The new code may then be sent to the remote control device at S680, and setting (S640) and testing (S650 and S660) of circuitry may be repeated based on the new code. Obtaining a new code may be automated such that the process automatically proceeds to a next code of the database to continue repeating obtaining (S670), sending (S680), setting (S640) and testing (S650 and S660) until a successful test occurs, all codes of the database are attempted, or the process is interrupted, for example, by the user (or a lack of user response leading to a test time out event). In another embodiment, the process may only use a subset of the data base, e.g. only the codes associated with a single manufacturer or component type.

Once a successful test occurs, the setup of the remote control device to control functions of the target auxiliary controllable electronic device may be completed at S690. This may involve leaving the circuitry as set based on the code that produced the successful test and exiting the setup mode. Alternatively, this may involve setting further circuitry of the remote control device based on the successful code and then exiting the setup mode. For example, the successful test of the code may cause additional data from the database to be sent to the remote control device based on the successful code. This may occur when the code is configured to set circuitry of the remote control device to control only a particular function. In such case, the database may include additional data, such as a codeset, associated with the code that may be sent to the remote control device to set additional circuitry of the remote control device to control additional functions of the target auxiliary controllable electronic device. For example, successfully setting a mute function may cause related functions, such as volume up and down, to be uploaded to the remote control device.

It should be understood that the foregoing method 600 is only an example, and that modifications may be made without altering the general principles. For example, it should be understood that a reverse convention may equally be applied. That is, a user input or a signal from the device may indicate an unsuccessful test of the set circuitry, and no input or signal may result in completing setup of the remote control device based on the received code. As such, the user input or signal may trigger the obtaining of a new code (S670).

In view of the foregoing, it should be understood that, in general, the setup controller may be configured to set circuitry of the remote control device based on an appropriate code from the database. Thus, the remote control device need not include the database or include memory/storage for the database. In the case of multiple remote control devices mentioned above, each of the remote control devices may be setup in such a manner to be able to control respective auxiliary controllable electronic devices in addition to the main controllable electronic device. It should be understood that this approach may be extended, as appropriate or desired, to allow circuitry of the remote control device(s) to be set to control the main controllable electronic device(s) as well, for example, when the remote control device(s) is/are not preset to be configured to control the main controllable electronic device(s), such as a universal remote control device.

Figure 7A:
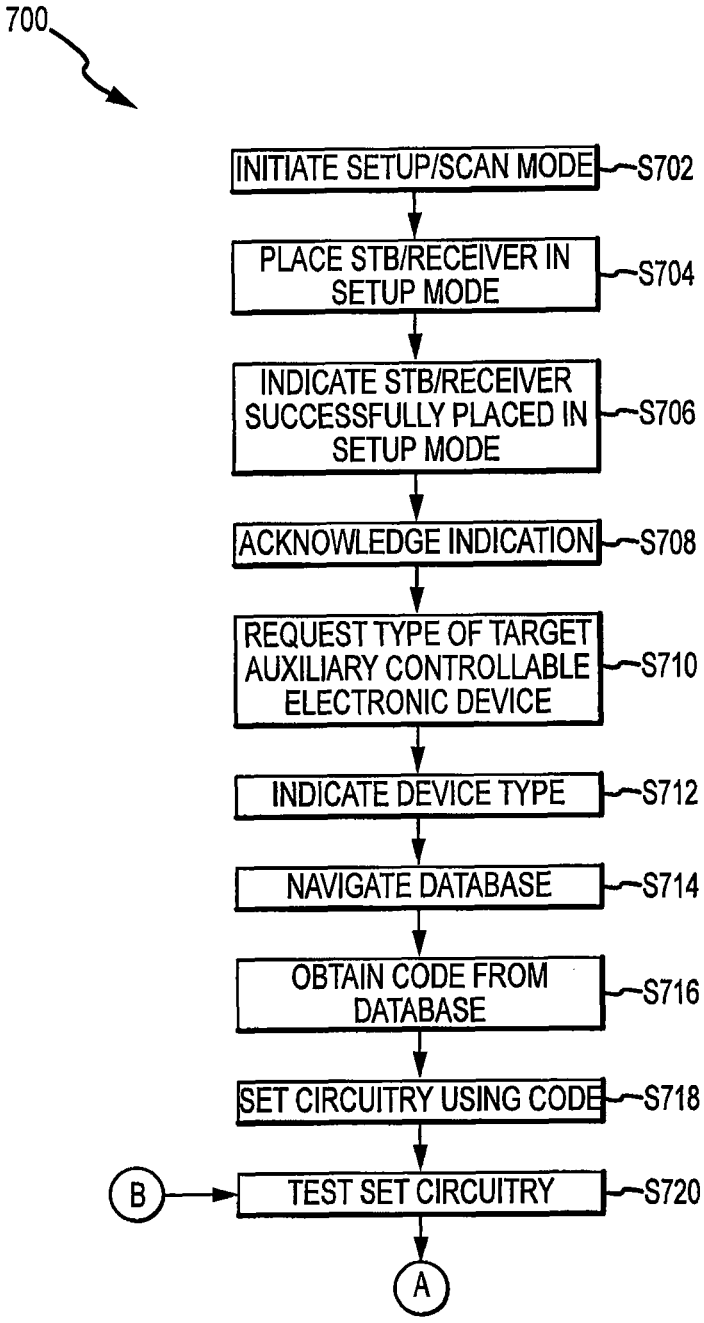
FIG. 7 is a flowchart illustrating a more detailed example of a method for setup of a remote control device.
Figure 7B:
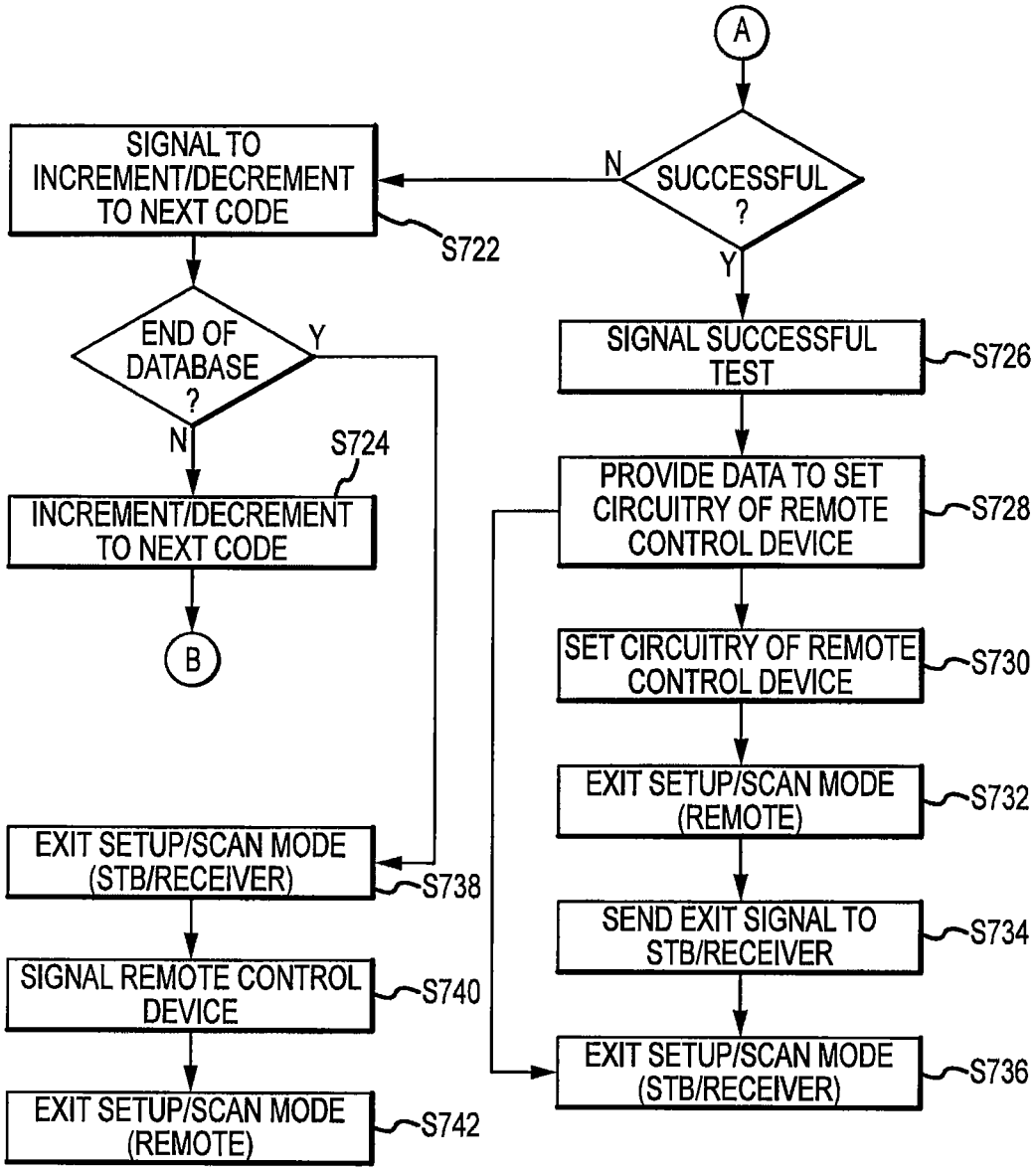

Although various methods will be apparent based on the foregoing discussion, a more detailed example of a method 700 is provided in the flowchart of FIG. 7. Although the method 700 may be implemented for a different function, such as power, the method 700 is described only in terms of the mute function for the sake of clarity. The selection between functions, such as mute and power, for scanning the database of codes may be requested or required by the STB/receiver before performing the scanning.

The process may begin at S702, where a setup or scan mode may be initiated by the remote control device. For example, a user may press and/or hold a mode key/icon/button to place the remote control device in the scan mode and to send a signal to the STB/receiver. Upon receipt of the signal, the STB/receiver may be placed in the setup mode at S704. Simultaneously with entering the setup mode at S704, the STB/receiver may display menus and/or user instructions on a display device, such as a front panel display (208) or on a connected device, such as a TV/monitor (120), and/or the remote control device may display such menus and/or instructions. Then, at S706, the STB/receiver may send a signal/message to the remote control device indicating that the STB/receiver has successfully be placed in the scan mode. The remote control device may acknowledge the signal message by sending a suitable signal/message to the STB/receiver at S708.

As discussed below, in the setup or scan mode, the remote control device may be configured to have circuitry set to control interactions with the STB/receiver in the setup or scan mode. For example, certain buttons may be set to control a different function of the STB/receiver than would be controlled by such buttons when not in the setup or scan mode. Further, the STB/receiver may be configured to perform certain functions, such as accessing the database, that it may not perform when not in the setup or scan mode.

It should be understood that, alternatively, the setup or scan mode may be initiated by the STB/receiver. In such case, the foregoing communications between the remote control device and the STB/receiver may be reversed.

In either case, upon receipt of a suitable signal/message indicating that both the STB/receiver and the remote control device are in the scan mode, the STB/receiver may require or request the remote control device to indicate the type and/or manufacturer of the target auxiliary controllable electronic device at S710. Indicating the device type at S712 may allow the STB/receiver to begin scanning at an appropriate code of the database, or even limit the codes to be scanned to codes associated with devices of the indicated type. In some embodiments, the user may have the option of entering the model number of the target device. Such approaches may enhance the efficiency of the scanning.

Next, at S714, the remote control device may be operated, for example, by pushing an appropriate button, to send a signal to the STB/receiver to navigate through the database. For example, different buttons may be set to cause the STB/receiver to respectively increment and decrement between adjacent codes in the database and retrieve the corresponding code in turn. Thus, at S716, the STB/receiver may obtain and send a code from the database to the remote control device. As discussed above, the STB/receiver may obtain the code from a separate device storing the database, or may access the database being stored in the STB/receiver, as appropriate of desired.

The code received by the remote control device may be used at S718 to set circuitry to control the mute function of the target auxiliary controllable electronic device. The set circuitry may be tested to confirm successful operation of the mute function by the target auxiliary controllable electronic device in response to a signal from the set circuitry at S720. When operation of the mute function is not successful, the user may press an appropriate button to send a signal to the STB/receiver to increment or decrement to a next code in the database at S722. In response, at S724, the STB/receiver may increment/decrement to the next code and send the next code to the remote control device, whereby the setting and testing operations may be repeated. This loop of operations may continue until circuitry setting(s) based on a code is/are successfully tested, an end of the database is reached by providing all suitable codes to the remote control device for setting and testing circuitry, or the process is otherwise interrupted.

When set circuitry is successful to control the mute function of the target auxiliary controllable electronic device, the user may press a suitable button of the remote control at S726 to cause the remote control device to send a signal to the STB/receiver. In response to the signal, the STB/receiver may at S728 reply by data configured to set circuitry of the remote control device to control one or more functions of the target auxiliary controllable electronic device. The operation at S728 may be repeated, as necessary or desired, to provide additional such data to the remote control device. Either between instances of the operation at S728, concurrently with instances of the operation at S728, and/or after completion of instances of the operation at S728, the circuitry of the remote control device may be set based on such data to control corresponding functions of the target auxiliary controllable electronic device at S730.

Either upon completion of instances of the operation at S728 or upon completion of the setting of the circuitry of the remote control device at S730, the remote control device may automatically turn off or exit the setup or scan mode at S732 and may automatically send a signal at S734 to cause the STB/receiver to turn off or exit the setup or scan mode. Alternatively, the STB/receiver may automatically turn off or exit the setup or scan mode at S736 upon the last instance of the operation at S728, and may send a signal indicating the last instance so that the remote control device may know to automatically turn off or exit the setup or scan mode.

When an end of the database is reached, the STB/receiver may automatically turn off or exit the setup or scan mode at S738 and may automatically send a signal at S740 indicating such to cause the remote control device to turn off or exit the setup or scan mode at S742.

It should be understood that the flowchart of FIG. 7 is only an example, and that other methods, whether by addition of operations, omission of operations, and/or reordering of operations, may be envisioned. As such, it should be understood that any suitable flow of operations may be determined as appropriate or desired for a given implementation of controllable electronic device(s) and remote control device(s) based on the description provided herein. For example, other particular implementations may be understood from the attached Appendix, which is incorporated herein by reference in its entirety, setting forth detailed operations of "mute scanning" and "power scanning" for setup of a remote control device.

The foregoing merely illustrates the principles of the invention. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the invention and are thus within the spirit and scope of the present invention. From the above description and drawings, it will be understood by those of ordinary skill in the art that the particular embodiments shown and described are for purposes of illustration only and are not intended to limit the scope of the present invention. References to details of particular embodiments are not intended to limit the scope of the invention.

What is claimed is:

1. A remote control device, comprising:

a wireless transmitter;

a memory;

first circuitry disposed within the remote control device configured to generate signals using the wireless transmitter to thereby wirelessly control at least one function of a first controllable electronic device upon receipt of a first user input;

second circuitry disposed within the remote control device configured to be set to generate signals using the wireless transmitter to thereby wirelessly control at least one function of an auxiliary controllable electronic device upon receipt of a second user input; and a setup controller configured to initially obtain a digital code associated with the auxiliary controllable electronic device from the first controllable electronic device and to store the digital code associated with the auxiliary controllable electronic device in the memory, wherein the digital code is subsequently retrieved from the memory prior to receipt of the second user input to set the second circuitry to wirelessly control the auxiliary controllable electronic device, wherein the signals generated by the wireless transmitter are controlled by the second circuitry based upon the digital code associated with the auxiliary controllable electronic device that is retrieved from the memory, wherein the remote control device is configured to test the digital code initially obtained from the first controllable electronic device and, if the test of the digital code is unsuccessful, to re-query the first controllable electronic device for another digital code.

2. The device of claim 1, wherein the at least one function of the target auxiliary controllable electronic device is a single predetermined function.

3. The device of claim 2, wherein the remote control device is configured to request a codeset from the first controllable electronic device when the digital code received from the first controllable electronic device allows the setup controller to set the second circuitry to wirelessly control the single predetermined function of the target auxiliary controllable electronic device, the requested codeset corresponding to the code and allowing the setup controller to set the second circuitry to wirelessly control at least a second function of the target auxiliary controllable electronic device.

4. The device of claim 1, wherein the remote control device is configured to continue repeatedly querying the first controllable electronic device until the digital code received from the first controllable electronic device allows the setup controller to set the second circuitry to wirelessly control at least one function of the target auxiliary controllable electronic device.

5. The device of claim 1, wherein the remote control device is configured to request a codeset from the first controllable electronic device when the digital code received from the first controllable electronic device allows the setup controller to set the second circuitry to wirelessly control at least one function of the target auxiliary controllable electronic, the requested codeset corresponding to the code and allowing the setup controller to set the second circuitry to wirelessly control at least a second function of the target auxiliary controllable electronic device.

6. A controllable electronic device configured to be controlled by a remote control device, the controllable electronic device comprising:

an input device configured to receive at least one wireless signal from the remote control device;

an output device configured to send at least one wireless signal to the remote control device in response to the at least one wireless signal from the remote control device; and a processor coupled to the input device and to the output device, configured to access a database of digital codes and to selectively provide a plurality of digital codes making up only a subset of the digital codes from the database to the remote control device via the output device for storage on the remote control device, the digital codes being configured to set circuitry of the remote control device to directly generate instructions that wirelessly control at least one function of another controllable electronic device in response to subsequent user inputs received at the remote control device, to thereby allow the remote control device to sequentially test the plurality of digital codes in the subset until one of the digital codes is successful in controlling a second controlled device.

7. The device of claim 6, further comprising a storage device, wherein the storage device stores the database of digital codes to be accessed by the processor.

8. The device of claim 6, wherein the processor is configured to provide a first digital code from the database in response to a first query signal from the remote control device, and is configured to provide a different digital code from the database in response to a subsequent query signal from the remote control device.

9. The device of claim 6, wherein the processor is configured to provide a different digital code from the database in response to different instances of a query signal from the remote control device that requests a digital code.

10. The device of claim 6, wherein the processor is configured selectively provide the subset of the digital codes based on information regarding the another controllable electronic device.

11. The device of claim 6, wherein the processor is configured to access a database of codesets and to provide a desired codeset from the database to the remote control device via the output device, the codesets corresponding to respective digital codes and being configured to set circuitry of the remote control device to wirelessly control at least a second function of the another controllable electronic device.

12. The device of claim 11, further comprising a storage device, wherein the storage device stores the database of codesets to be accessed by the processor.

13. A method executable by a configurable remote control device that wirelessly controls a plurality of controllable electronic devices, the method comprising:

transmitting a first signal from the remote control device to a first one of the plurality of electronic devices using a wireless transmitter of the remote control device;

receiving a first code at the remote control device from the first controllable electronic device in response to the first signal, wherein the first code describes wireless signals compatible with a second one of the plurality of electronic devices;

testing the first code to determine if the first code is compatible with the second one of the plurality of electronic devices; and if the test is unsuccessful, obtaining replacement codes from the first controllable electronic device; and if the test is successful, storing the first code in a memory of the remote control device;

subsequently retrieving the first code from the memory prior to receipt of a user input directing the remote control device to provide a command to the second one of the plurality of electronic devices; and generating a generated signal using the wireless transmitter of the remote control device to thereby provide the command to the second one of the plurality of electronic devices, wherein the generated signal is based on the first code associated with the second electronic device that is retrieved from the memory.

14. The method of claim 13, further comprising:

transmitting a second signal from the remote control device to the first controllable electronic device if the first code received by the remote control device was unsuccessful in producing desired effects in the second electronic device;

receiving a second code at the remote control device from the first electronic device in response to the second signal, wherein the second code is configured to produce the same desired effects as the first code in different types of controlled electronic devices; and storing the second code in the memory of the remote control.

15. The method of claim 14, further comprising receiving a codeset corresponding to the second code to the remote control device from the first controllable electronic device in response to a third signal from the remote control device indicating that the second code successfully set some of the plurality of circuitry to wirelessly control at least one function of a target controllable electronic device, the codeset configured to set some of the circuitry to wirelessly control at least a second function of the target controllable electronic device.

16. The method of claim 13, wherein the first and second signals from the remote control device are queries for a code, and wherein codes are iteratively communicated from a database of codes to the remote control device from the first controllable electronic device in response to subsequent queries.

17. The method of claim 13 wherein the generated signal is independently generated by the remote control device in response to the user input based upon the first code.

18. The method of claim 14 wherein the generated signal is independently generated by the remote control device in response to the user input based upon the first code without further communication with the first controllable electronic device.

* * * * *